US007563143B2

(12) United States Patent
Okabe et al.

(10) Patent No.: US 7,563,143 B2
(45) Date of Patent: Jul. 21, 2009

(54) LIGHTING APPARATUS

(75) Inventors: Toshiaki Okabe, Shizuoka (JP); Yasunobu Gotou, Shizuoka (JP); Masayuki Hirano, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/984,939

(22) Filed: Nov. 26, 2007

(65) Prior Publication Data

US 2008/0137354 A1 Jun. 12, 2008

(30) Foreign Application Priority Data

Dec. 6, 2006 (JP) ..... 2006-329120

(51) Int. Cl.
*H01R 24/00* (2006.01)

(52) U.S. Cl. ..... 439/699.2; 439/221

(58) Field of Classification Search ..... 439/699.2, 439/221, 417, 419, 414, 442
See application file for complete search history.

(56) References Cited

U.S. PATENT DOCUMENTS 4,418,973 A * 12/1983 Smetana et al. ..... 439/168
5,562,481 A * 10/1996 Myson ..... 439/419
6,250,970 B1 * 6/2001 Key et al. ..... 439/699.2
6,971,904 B2 * 12/2005 Wallmeier ..... 439/419
7,192,315 B2 * 3/2007 Powers et al. ..... 439/699.2
2006/0052010 A1 * 3/2006 Dietz et al. ..... 439/699.2

FOREIGN PATENT DOCUMENTS

JP 2005-329883 12/2005

* cited by examiner

*Primary Examiner*—Briggitte R Hammond
(74) *Attorney, Agent, or Firm*—Edwards Angell Palmer & Dodge LLP

(57) ABSTRACT

The present invention is to provide a lighting apparatus with compact size. The lighting apparatus includes a housing receiving an electric bulb and a pair of busbars. The pair of the busbars each include an electrode connection portion and an electrical cable connection portion. The electrode connection portion is connected to an electrode of the electric bulb. The electrical cable connection portion interconnects the electrode connection portion and a flat cable. The electrical cable connection portion is bent at a right angle at a connection portion thereof with the electrode connection portion and extends in a direction perpendicular to a longitudinal direction of the electrode connection portion and is disposed on exterior surface of a rear end portion of the housing.

3 Claims, 10 Drawing Sheets

LIGHTING APPARATUS

BACKGROUND OF THE INVENTION

1. Field of the Invention

The present invention relates to a lighting apparatus of a vehicle.

2. Description of the Related Art

A variety of lighting apparatuses of a vehicle have been proposed, for example JP-2005-329883-A. The lighting apparatuses each include a housing receiving an electric bulb and a busbar attached to the housing for connecting the electric bulb and an electrical cable.

Referring to FIG. 9, a lighting apparatus of a vehicle includes a pair of busbars 100A and 100B which are connected to positive and negative electrodes of an electric bulb through electrode connection portions 101. Electrical power is supplied to the electric bulb through electrical cable connection portions 102 connected with electrical cables.

The electrical cable connection portions 102 each are longitudinally connected with one end portion of the electrode connection portion 101 and each include a strip-shaped bottom wall 103 and a pair of piercing blades 104. The bottom walls 103 extend in a longitudinal direction of the electrical cable connection portions 101. The piercing blades 104 are upstanding from opposite ends in a width direction and have slits 105 therein. The piercing blades 104 of the electrical cable connection portions 102 are force pressed into an electrical cable 200 to accept core wires 202 into the slits 105 as shown in FIGS. 11-12. The electrical cable 200 is a flat cable having a plurality of core wires 202 juxtaposed each other and covered with an insulation cover 201.

The busbars 100A and 100B of FIG. 9 as described above are formed by bending busbars 100A' and 100B' of FIG. 10 a whole of which is stamped out of one electrically conductive metal plate. The stamped busbars 100A' and 100B' have a bridge 110 to avoid displacement of the relevant portions when stamping or bending thereof. The bridge 110 thereof is cut out when the busbars are formed.

As depicted in FIG. 9, both piercing blades 104 of the busbars 100A and 100B are not lined up in a width direction thereof or shifted in the longitudinal direction of the bottom walls 103 in order to make insulation displacement contact with the associated core wires 202. The one bottom wall 103 of the busbar 100B extends longer than the another bottom wall 103 of the busbar 100A.

The conventional lighting apparatus having the busbars 100A and 100B has several drawbacks as described below.

The busbars 100A and 100B extend along the longitudinal direction of the electrode connection portions 101, so that the dimension of the lighting apparatus becomes relatively larger.

Pitch of the core wires 202 of the flat cable 200 has recently become narrower to make the flat cable lightweight and more compact. The stamped busbars 100A' and 100B' thus have the piercing blades 104' which are shifted each other in the longitudinal direction of the bottom walls 103' so that the piercing blades 104' are not overlapped each other as shown in FIG. 10. It is difficult to make the pitch P between the slits 105 of the conventional busbars 100A and 100B as small as the pitch of the core wires 202 of the flat cable 200.

Several methods are disclosed to achieve the insulation displacement contact for the flat cable 200 having the narrow pitch of the core wires. FIG. 11 shows that the piercing blades 104 are force contacted the outer core wires 202 among the three core wires 202 and the center core wire 202 runs between the piercing blades 104. FIG. 12 shows that the pitch of the core wires 202 is spread by cutting and opening the insulation cover 201 of the flat cable 200 to allow piercing of the piercing blades 104.

In order to narrow the pitch P between the slits 105 of the busbars 100A and 100B, the stamped busbars 100A' and 100B' can be further separated each other in the width direction. However, this causes reduction of yield of the electrically conductive metal plate, resulting in increase cost of production of the busbars 100A and 100B.

SUMMARY OF THE INVENTION

An object of the present invention is to provide a lighting apparatus having a busbar interconnecting between an electric bulb and an electrical wire of a flat cable, the busbar being capable of becoming smaller and manufactured with low cost.

According to a first aspect of the present invention, a lighting apparatus includes a housing receiving an electric bulb; and a plurality of busbars disposed in the housing for connecting the electric bulb with an electrical cable, the busbars each having an electrode connection portion to be connected with an electrode of the electric bulb and an electrical cable connection portion to be connected with the electrical cable, wherein the electrical cable connection portions are bent at connection places between the electrical cable connection portions and the electrode connection portions, and extend in a direction crossing a longitudinal direction of the electrode connection portions.

Preferably, the busbars are formed by stamping one electrically conductive metal plate in the same shape and by bending the stamped busbars, the stamped busbars are in parallel each other in a width direction thereof, the stamped busbars each have an associated electrode connection portion and an associated electrical cable connection, and the associated electrical cable connection portions each have a bottom wall longitudinally connected with one end portion of the associated electrode connection portion and extending in a direction crossing the longitudinal direction of the electrode connection portion.

Preferably, the associated bottom walls each include piercing blades extending widthwise outwardly from both sides of the bottom wall.

Preferably, the associated bottom walls each include piercing claws extending widthwise outwardly from both sides of the bottom wall.

Preferably, the electrical cable is a flat cable having a plurality of conductors in parallel with a circular cross section and an insulation cover covering the conductors.

Preferably, the electrical cable is a flat cable having a plurality of conductors in parallel with a rectangular cross section and an insulation cover covering the conductors.

DETAILED DESCRIPTION OF THE PREFERRED EMBODIMENTS

Figure 1:
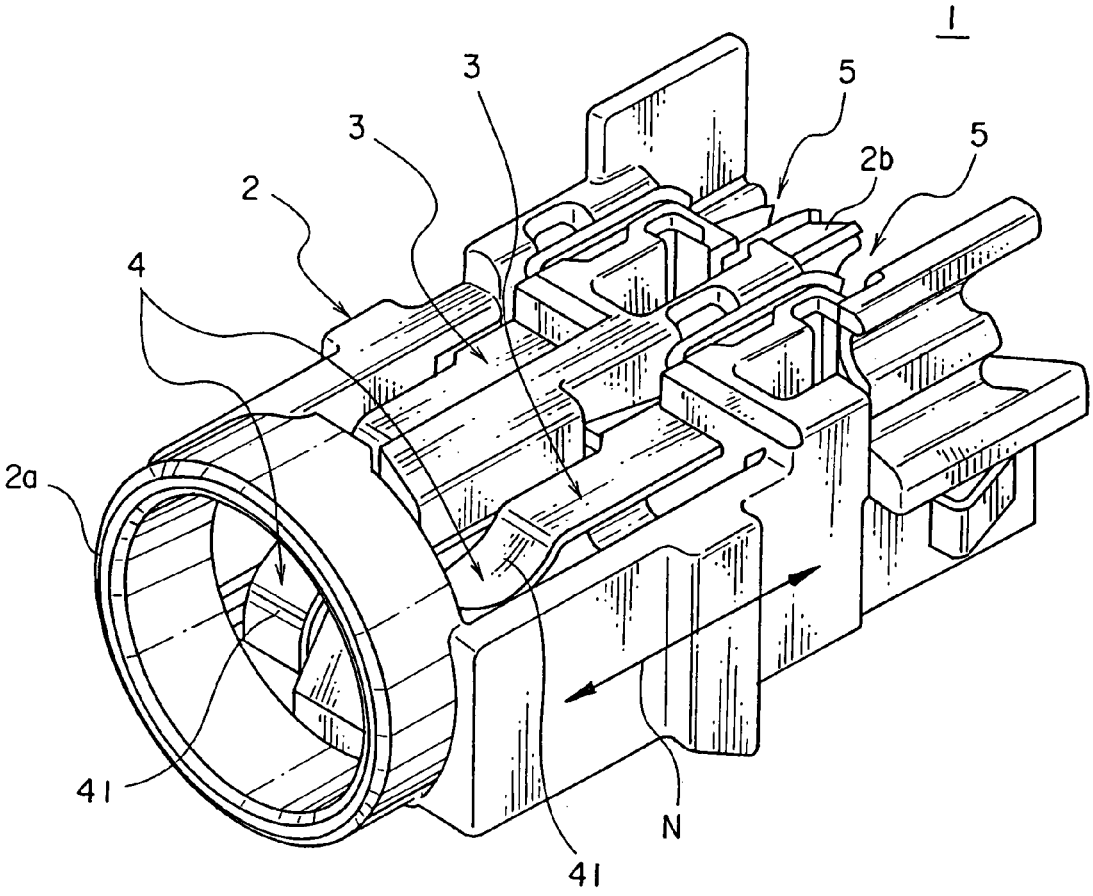
FIG. 1 is a perspective view of a first embodiment of a lighting apparatus of the present invention.
Figure 2:
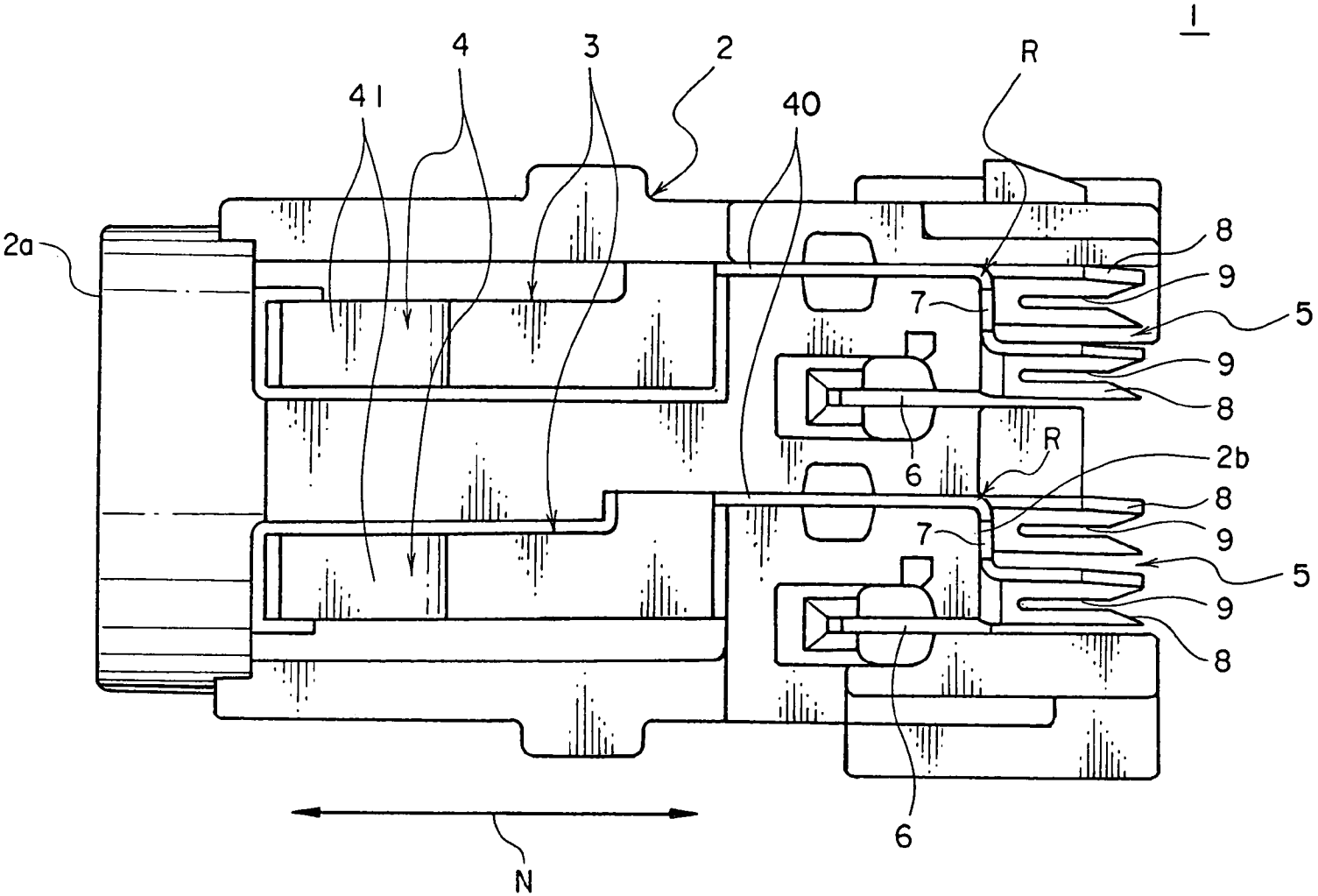
FIG. 2 is a plan view of the lighting apparatus of FIG. 1.
Figure 3:
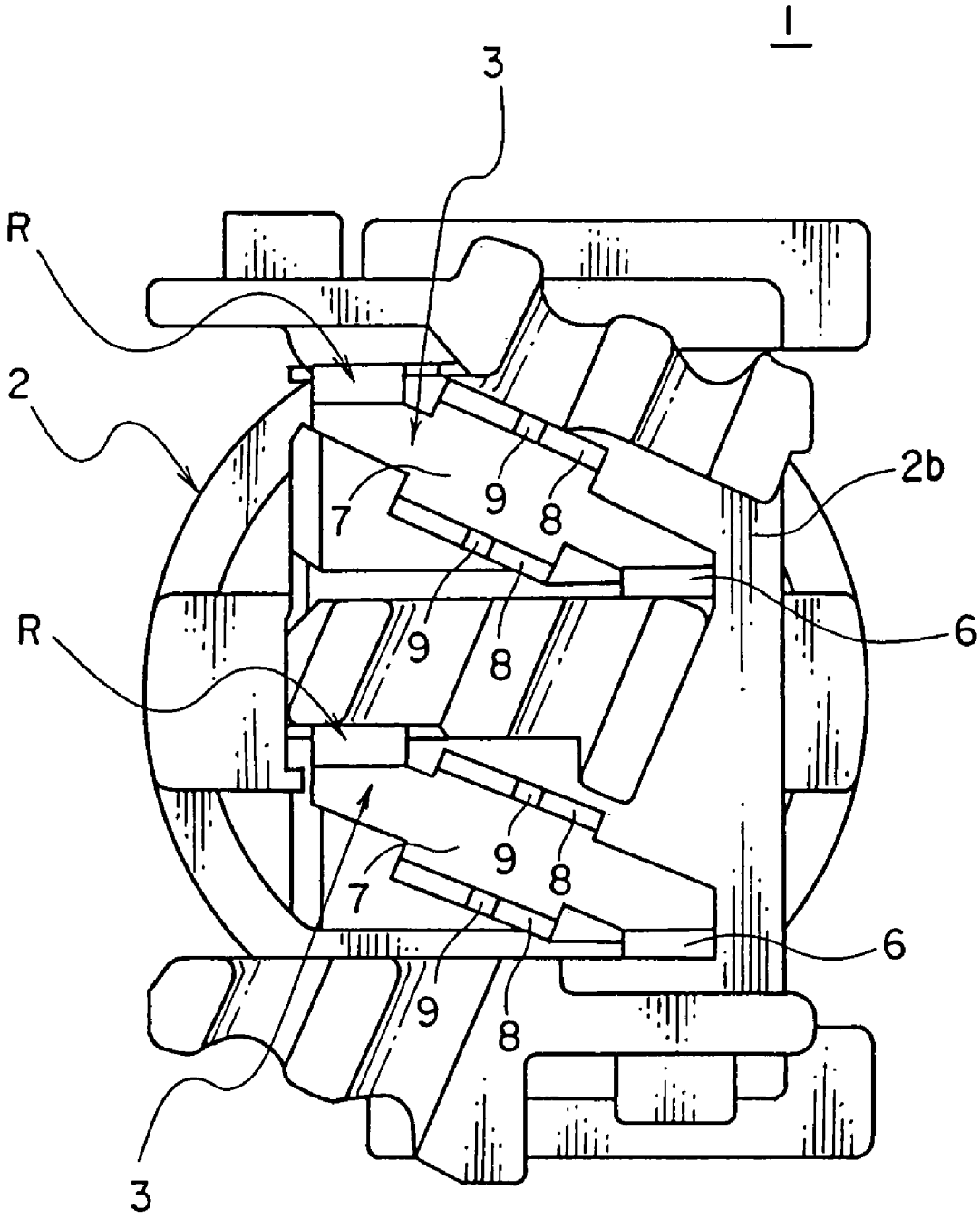
FIG. 3 is a rear front view of the lighting apparatus of FIG. 1.

FIGS. 1-6 show a first embodiment of a lighting apparatus 1 of the present invention. The lighting apparatus 1 is attached to a roof trim of a motor vehicle to illuminate interior of the motor vehicle. Referring to FIGS. 1-3, the lighting apparatus 1 of the motor vehicle includes an electric bulb 50 shown in FIG. 4, a housing 2 to receive the electric bulb 50, a pair of busbars 3 attached to the housing 2, and a switch (not shown). FIG. 1 shows that the electric bulb 50 is not attached to the housing 2. The electric bulb 50 is inserted into the housing 2 in a direction N denoted by an arrow through a front end portion 2*a*.

Figure 4:
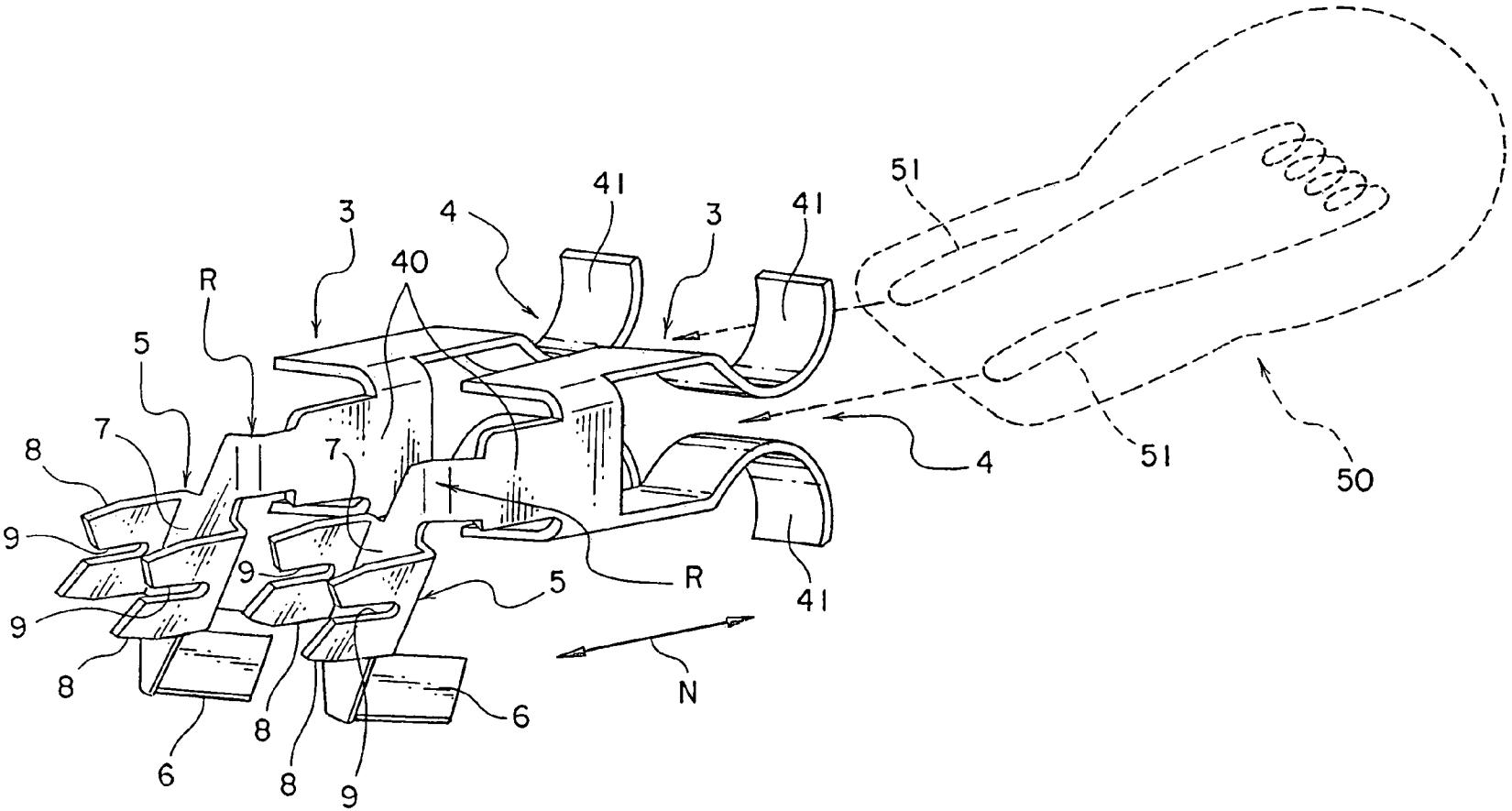
FIG. 4 is a perspective view of busbars of the lighting apparatus of FIG. 1.

The electric bulb 50 is a well known wedge bulb, and has an illuminant portion to emit light and a pair of electrodes 51 of positive and negative poles as shown in FIG. 4. LED wedge bulb can be utilized in place of the wedge bulb.

The housing 2 is made of an insulation synthetic resin and has a rectangular shape. The housing 2 has a plurality of cavities to receive the bulb 50 and the busbars 3.

Figure 5:
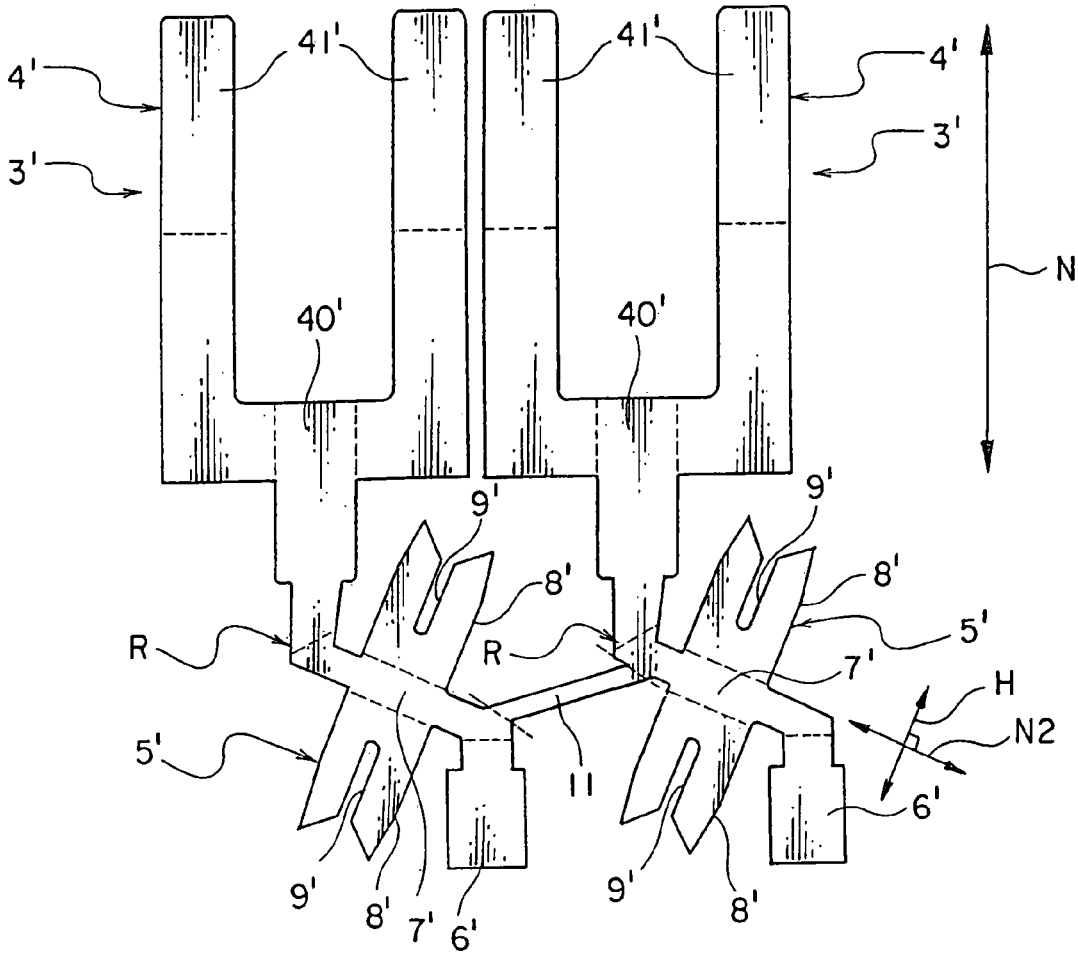
FIG. 5 is a plan view of stamped busbars to be formed in the busbars of FIG. 4.
Figure 6:
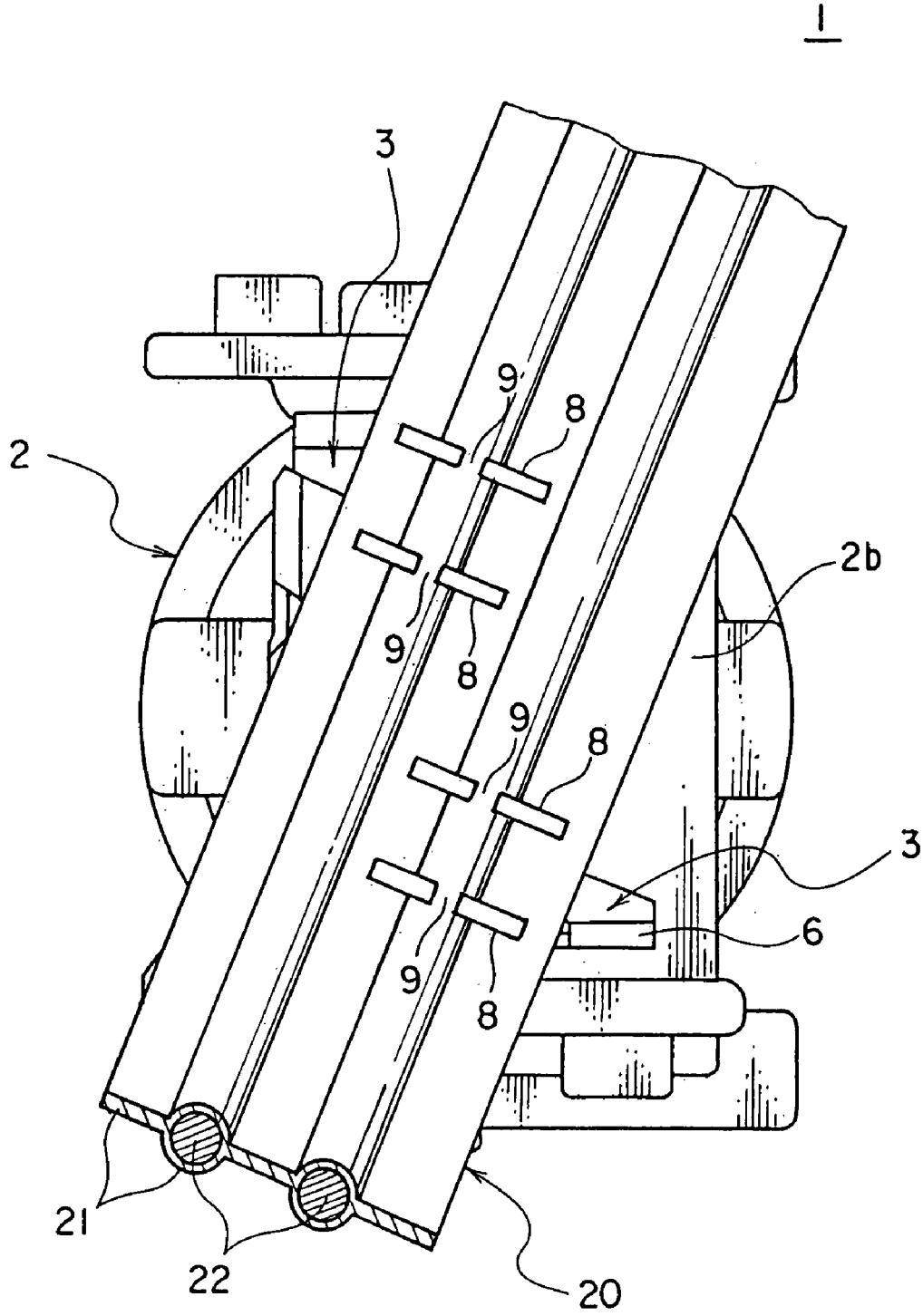
FIG. 6 is the rear front view of the lighting apparatus of FIG. 3 connected with an electrical cable.

The pair of busbars 3 have the same shape and are formed by stamping an electrically conductive metal plate and bending the relevant portions of the stamped busbars 3' of FIG. 5. Referring to FIG. 4, each of the busbar 3 includes an electrode connection portion 4 to connect with the electrode 51 of the electric bulb 50, an electrical cable connection portion 5 to connect with a flat cable 20 shown in FIG. 6, and an attachment portion 6. The stamped busbars 3' include the electrode connection portions 4', the electrical cable connection portions 5' and the attachment portion 6' corresponding to the respective portions of the busbars 3.

The electrode connection portions 4 are formed by bending the corresponding portions 4' of the stamped busbars 3'. The electrode connection portions 4 each have a pair of electrode holders 41 with a strip shape and a connection portion 40 interconnecting both ends of the electrode holders 41. Referring to FIG. 4, the electrode holders 41 are formed in a convex shape to allow insertion of positive or negative electrode of the electric bulb 50 and make electrical contact therebetween. FIG. 5 shows the electrode holders 41' and connection portions 40' of the stamped busbars 3' corresponding to the relevant portions of the busbars 3 of FIG. 4.

The electrical cable connection portions 5 are formed by bending the corresponding portions 5' of the stamped busbars 3'. As shown in FIG. 5, the electrical cable connection portions 5' of the stamped busbars 3' are connected with the connection portions 40' which are longitudinally connected with the electrode connection portions 4'. The electrical cable connection portions 5' each include a bottom wall 7' and a pair of piercing blades 8'. The bottom walls 7' extend into a direction crossing the longitudinal direction of the electrode connection portions 4' of the stamped busbars 3'. The pair of the piercing blades 8' extend outwardly from both sides of the bottom wall 7' in a width direction H intersecting the longitudinal direction N2 of the bottom wall 7' as shown in FIG. 5.

In order to form the busbars 3 with the stamped busbars 3', connection places R are formed to have a right angle by bending the connection portions 40' and the bottom walls 7' of the stamped busbars 3', and the piercing blades 8' and the bottom walls 7' are bent to form a right angle with respect to each other. The formed busbars 3 then have the bottom walls 7 and the pair of piercing blades 8 as shown in FIG. 4. The bottom walls 7, or the electrical cable connection portions 5 extend into the direction perpendicular to the lengthwise direction of the electrode connection portions 4. The each pair of the piercing blades 8 are opposed to each other and upstanding from the bottom wall 7 away from the electrode connection portion 4.

The pairs of the piercing blades 8 include slits 9 extending from distal ends of the piercing blades 8 toward the bottom walls 7.

The piercing blades 8 are force-inserted into the flat cable 20 so that the slits 9 receive core wires 22 of the flat cable 20 and electrically contact the core wires 22. The flat cable 20 includes the plurality of core wires 22 with circular section and an insulation cover 21 covering the core wires 22. The core wires 22 are spaced and parallel to each other.

The attachment portions 6 are formed by bending attachment portions 6' of the stamped busbars 3'.

The pair of the busbars 3 are assembled into the housing 2 as shown in FIGS. 1-3 so that the busbars 3 are disposed in the width direction of the bottom walls 7. The electrode connection portions 4 are disposed interior of the housing 2 and the electrical cable connection portions 5 are disposed exterior of and along outer surfaces of rear end portions 2*b* of the housing 2. The attachment portions 6 are pressed into the housing 2 so that the busbars 3 are retained with the housing 2 as shown in FIG. 2. The pairs of the electrode holders 41 of the electrode connection portions 4 are disposed on the side of the front end portion 2*a* of the housing 2.

The pair of the busbars 3 are assembled into the housing 2. The electric bulb 50 is then inserted between the pairs of the electrode holders 41 and the flat cable 20 is force pressed against the pairs of the piercing blades 8 of the electrical cable connection portions 5. The busbars 3 thus electrically connect the electric bulb 50 and the flat cable 20. A switch (not shown) is connected to the pair of the busbars 3 to turn on or off the electric bulb 50.

The busbars 3' are formed by stamping the one electrically conductive metal plate so that the electrode connection portions 4' thereof align in parallel in across the width as shown in FIG. 5. The plurality of the busbars 3' (two in FIG. 5) are connected each other with a bridge 11, which is cut out when the busbars 3' are formed.

The electrical cable connection portions 5 of the busbars 3 of the present invention are bent at the connection places R so as to extend in the direction crossing the longitudinal direction of the electrode connection portions 4, and are disposed along the exterior surface of the housing 2. The longitudinal dimension of the busbars 3 becomes smaller and the housing 2 can be made smaller. The lighting apparatus 1 thus can be made smaller.

The bottom walls 7' of the stamped busbars 3' extend in the direction crossing the longitudinal direction of the electrode connection portions 4'. When the pair of the stamped busbars 3 are assembled in the housing 2, the piercing blades 8 are at a distance each other along the longitudinal direction of the bottom walls 7. The same type of the busbars 3 can thus be connected to the flat cable 20 having the parallel core wires 22 with the circular cross section.

The close arrangement of the busbars 3 allows connection of the flat cable 20 which has the narrower pitch of the core wires 22. The same type of the busbars 3 makes the busbars 3 smaller and save space between the electrical cable connection portions 5 and the flat cable 20. The same type of the busbars 3 reduces manufacturing cost of mass product.

The bottom walls 7' of the stamped busbars 3' extend in the direction crossing the longitudinal direction of the electrode connection portions 4' and the adjacent piercing blades 8' of the stamped busbars 3' are not overlapped each other. This arrangement of the piercing blades 8' allows a large area of thereof and permits stamping of the busbars 3' without loss of material.

Figure 7:
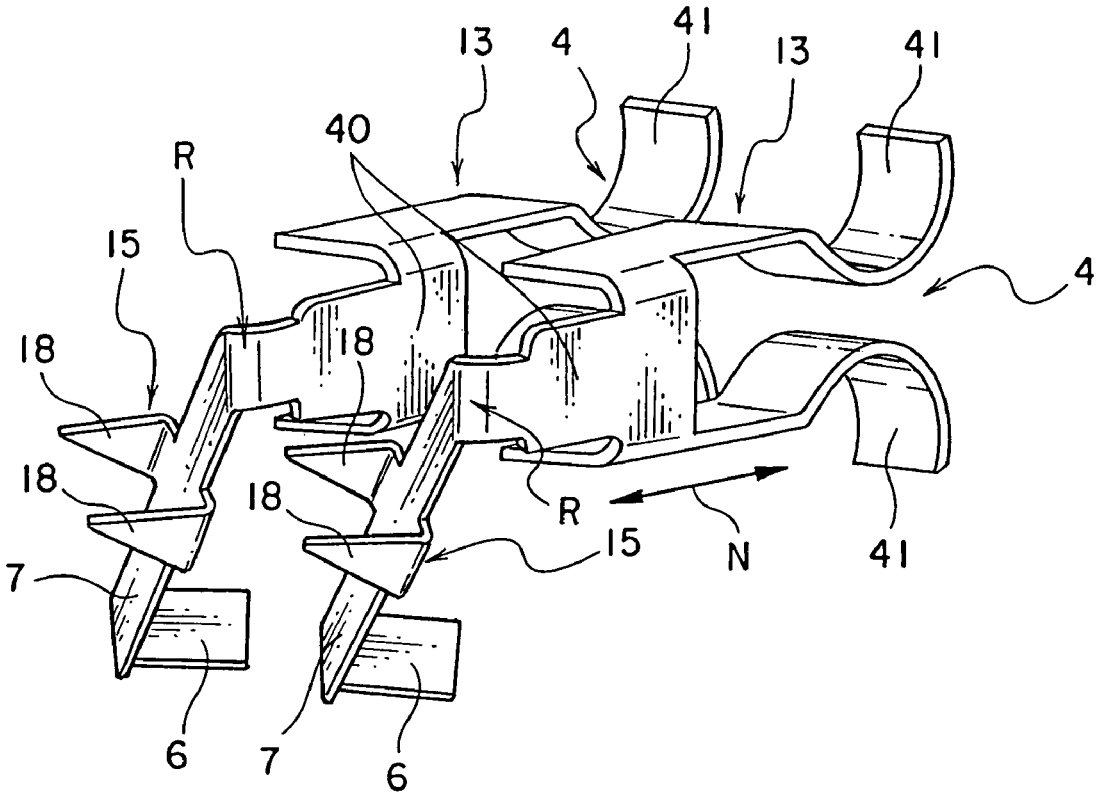
FIG. 7 is a perspective view of busbars of a second embodiment of the lighting apparatus of the present invention.
Figure 8:
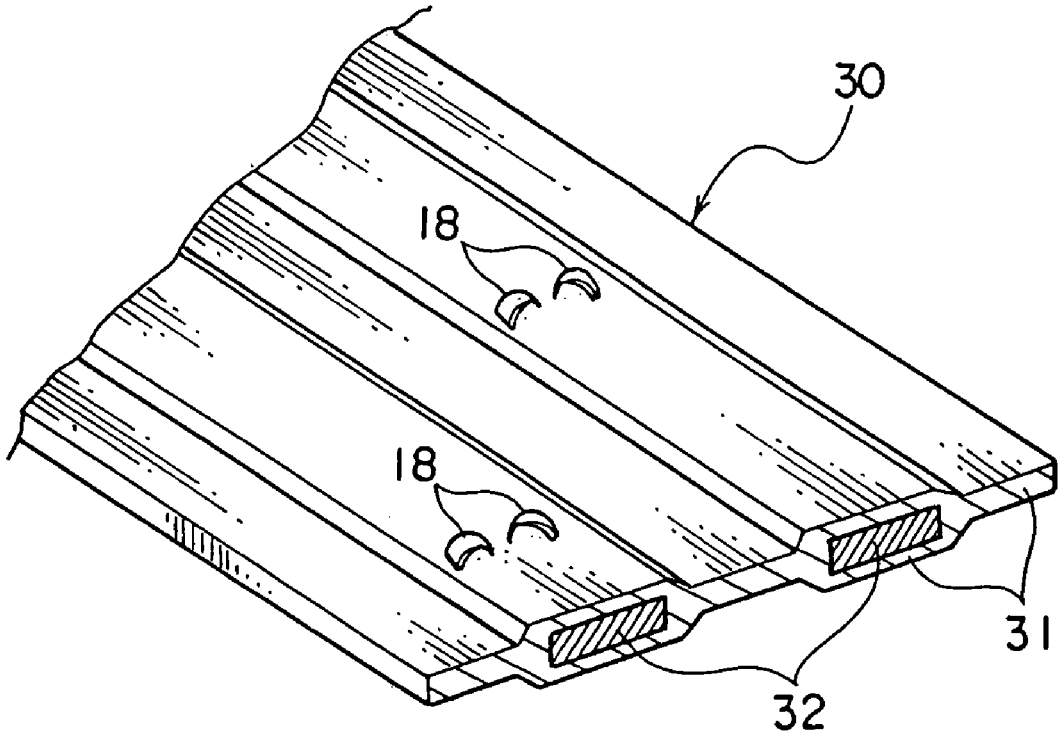
FIG. 8 is a perspective view of a flat cable pierced with the busbars of FIG. 7.
Figure 9:
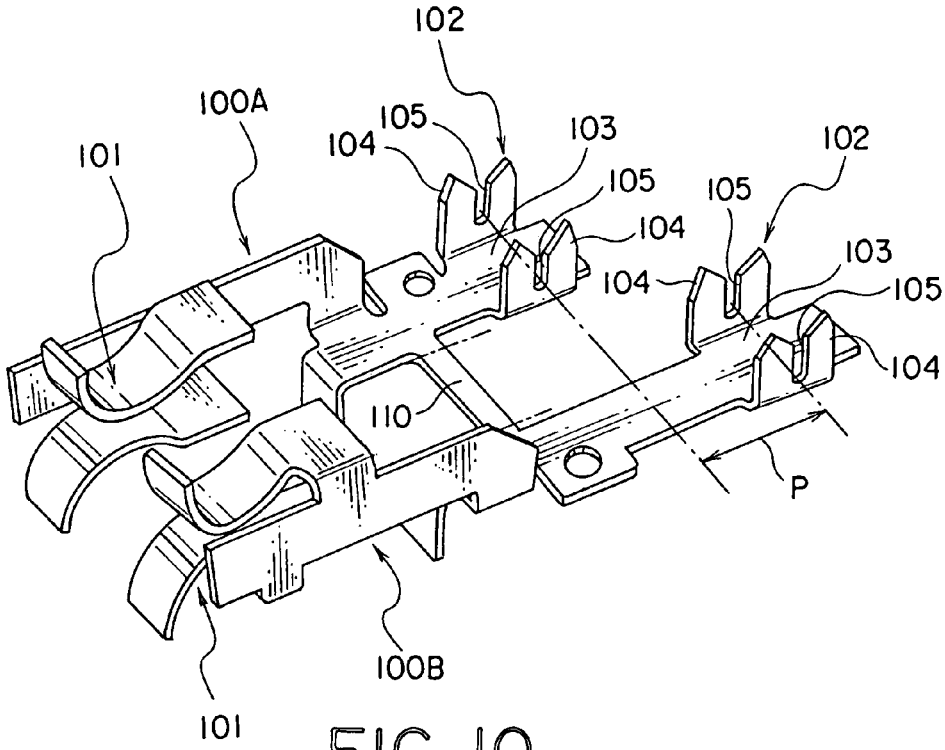
FIG. 9 PRIOR ART
FIG. 9 is a perspective view of a pair of busbars of a conventional lighting apparatus.
Figure 10:
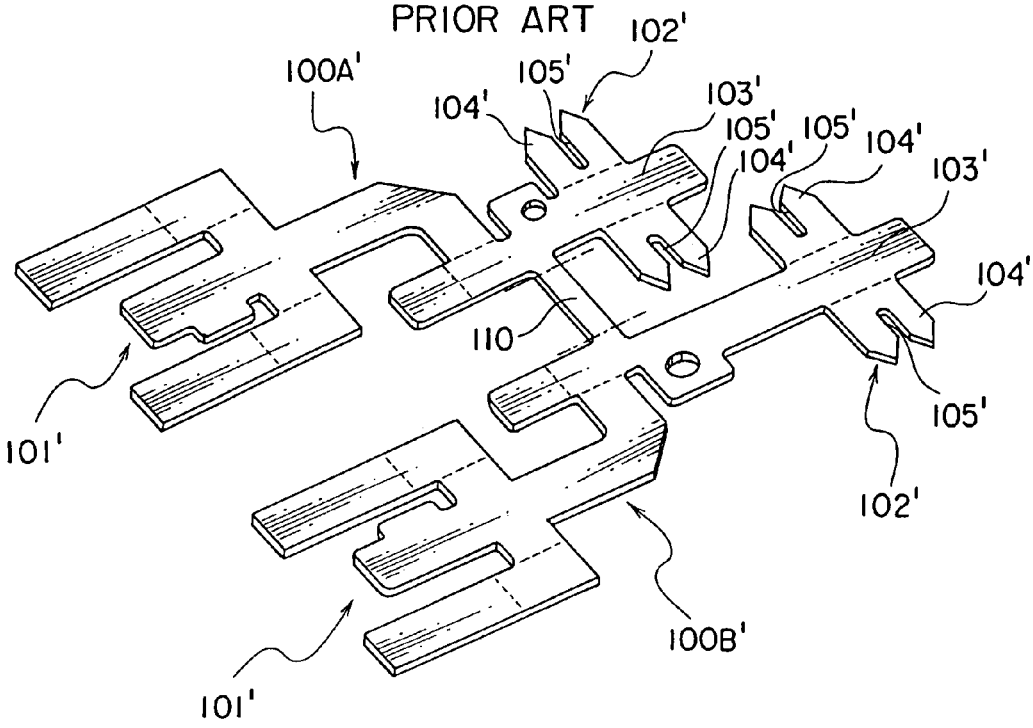
FIG. 10 PRIOR ART
FIG. 10 is a perspective view of a pair of stamped busbars to be formed in the busbars of FIG. 9.
Figure 11:
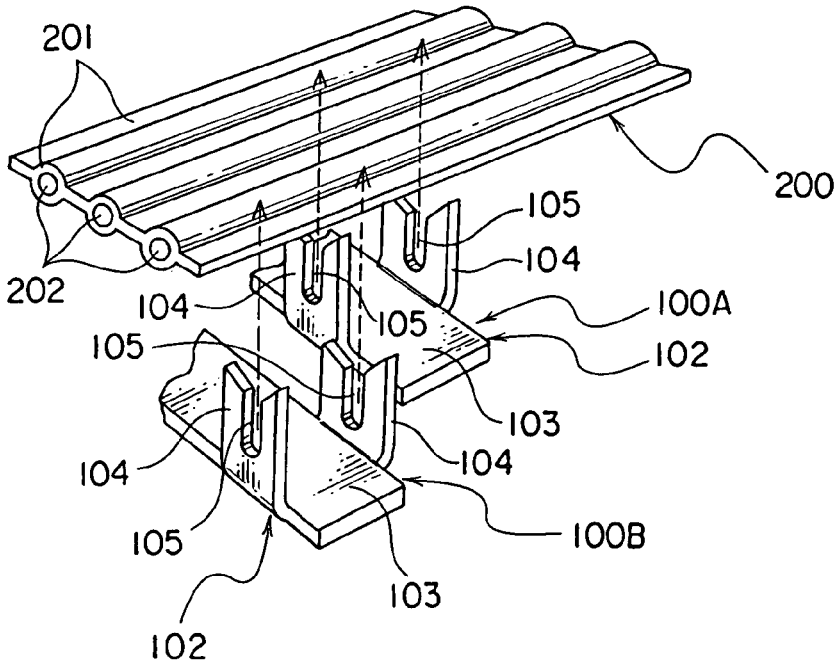
FIG. 11 PRIOR ART
FIG. 11 illustrates one method of connecting the pair of the busbars of FIG. 9 with a flat cable.
Figure 12:
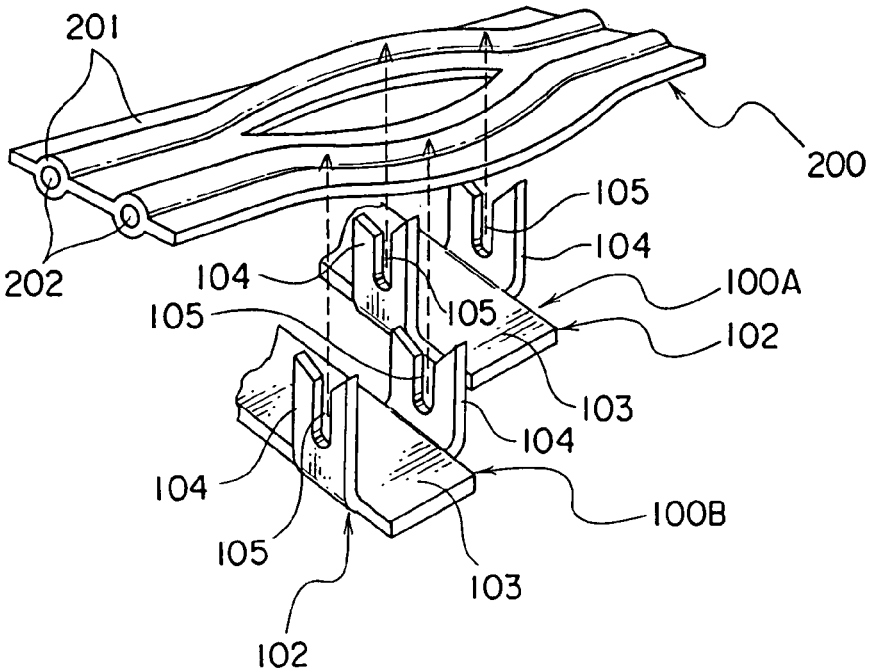
FIG. 12 PRIOR ART
FIG. 12 illustrates another method of connecting the pair of the busbars of FIG. 9 with the flat cable.

FIGS. 7-8 illustrate a second embodiment of a lighting apparatus of the present invention. Explanation is omitted for like numerals of like components as the first embodiment.

Referring to FIG. 7, busbars 13 each include an electrode connection portion 4, an electrical cable connection portion 15 connected with the electrode connection portion 4, and an attachment portion 6.

The electrical cable connection portions 15 each include a bottom wall 7 connected with a connection portion 40, and a pair of piercing claws 18 upstanding from opposite ends in a width direction of the bottom wall 7. The piercing claws 18 penetrate both an insulation cover 31 and electrical conductors 32 of a flat cable 30 to achieve electrical connection as shown in FIG. 8. The piercing claws 18 penetrated outside are then bent inwardly and toward the bottom walls 7 or crimped. The flat cable 30 includes the electrical conductors 32 with rectangular cross section and the insulation cover 31 covering the conductors 32. The conductors 32 are arranged in parallel to each other.

The busbars 13 are also formed by stamping one electrically conductive plate and bending the stamped busbars similarly to the first embodiment. Adjacent piercing claws of the stamped busbars (not shown) are not overlapped each other and the piercing claws can be made large size. The busbars are then manufactured with low material loss, resulting in low cost production of the lighting apparatus.

The electrical cable connector portions have either the piercing blades 8 or the piercing claws 18.

The embodiments of the present invention are only exemplary and not limited thereto. Any modification and alteration are within scope of the present invention.

What is claimed is:

1. A lighting apparatus comprising:

a housing receiving an electric bulb; and a plurality of busbars disposed in the housing for connecting the electric bulb with an electrical cable, the busbars each having an electrode connection portion to be connected with an electrode of the electric bulb and an electrical cable connection portion to be connected with the electrical cable, wherein each electrical cable connection portion has bottom wall and a piercing blade or a piercing claw upstanding from the bottom wall, the electrical cable connection portion being bent perpendicularly obliquely at a connection place between the electrical cable connection portion and the electrode connection portion away from the electrode connection portion so that the bottom wall perpendicularly crosses a longitudinal direction of the electrode connection portion, the bottom wall being disposed outside of the housing opposite the electric bulb so that the piercing blade or the piercing claw is oriented in a direction opposite the electrode connection portion.

2. The lighting apparatus as claimed in claim 1, wherein the electrical cable to be pierced with the piercing blade is a flat cable having a plurality of conductors in parallel with a circular cross section and an insulation cover covering the conductors.

3. The lighting apparatus as claimed in claim 1, wherein the electrical cable to be crimped with the piercing claw is a flat cable having a plurality of conductors in parallel with a rectangular cross section and an insulation cover covering the conductors.

* * * * *